US005761319A

United States Patent [19]

Dar et al.

[11] Patent Number: 5,761,319

[45] Date of Patent: Jun. 2, 1998

[54] HEARING INSTRUMENT

[75] Inventors: Barak Dar, Haifa, Israel; Horst Arndt, Ontario, Canada

[73] Assignee: AVR Communications Ltd., Migdal Ha'emek, Israel

[21] Appl. No.: 682,980

[22] Filed: Jul. 16, 1996

[51] Int. Cl.[6] ..... H04R 25/00

[52] U.S. Cl. ..... 381/68.7; 381/68.6; 381/69

[58] Field of Search ..... 381/68, 68.1, 68.2, 381/68.3, 68.4, 68.5, 68.6, 68.7, 23.1, 69, 69.2

[56] References Cited

FOREIGN PATENT DOCUMENTS 3625891 2/1988 Germany .

*Primary Examiner*—Huyen D. Le

*Attorney, Agent, or Firm*—Herbert Dubno

[57] ABSTRACT

To increase the versatility of an in-the-canal hearing aid, a behind-the-ear receiver for wireless transmission of signals is provided and is coupled whereby an air tube or by a cable terminating in the battery compartment of the in-the-canal unit, to the latter.

15 Claims, 4 Drawing Sheets

HEARING INSTRUMENT

FIELD OF THE INVENTION

The present invention relates to a hearing instrument and, more particularly, to a hearing instrument system utilizing an in the concha and in-the-canal type of hearing aids but affording enhanced versatility in the use of such devices.

BACKGROUND OF THE INVENTION

While hearing instruments can be of a wide variety of types, the most common modern hearing aids are behind the ear devices (BTE) which are worn behind the pinna of the ear and are coupled to an ear mold by an air conduction tube delivering amplified sound from the housing of the behind-the-ear device through the mold and to the ear canal. The BTE can include a microphone for picking up sound, an amplifier for amplifying that sound, an electroacoustic transducer for transforming the electrical output signals of the amplifier into acoustic signals which are transmitted to the air column in the tube, and a battery for powering the electrical circuitry of the BTE.

A smaller type of hearing aid is the in-the-ear device (ITE) in which the microphone, amplifier and battery all are included in a unit configured to fit within the ear.

More recently, and because of advantages of proximity to the tympanic membrane, an in-the-canal (ITC) hearing aid has been developed which fits in the ear canal or auricular meatus itself. Finally, mention should be made of the completely-in-the-canal type of hearing aid (CIC) which is lodged further in the ear canal and thus closer to the tympanic membrane. Hearing aids of the latter type are invisible from the exterior and have advantages with respect to sound delivery to the tympanic membrane or the hearing mechanisms deep within the ear.

While ITC and CIC devices have cosmetic appeal and certain acoustic advantages, the small sizes of such devices preclude the use of controls or conventional systems which have been used to couple in-the-ear and behind-the-ear devices to signal sources where high background noise may make such coupling advantagous. For example, it is known to provide behind the ear devices with inductive, hard wire or FM pick ups so that transmitters can deliver signals to the hearing aid directly and without the type of interference which may adversely affect hearing because of background noise. However, the small size of in-the-canal devices, i.e. both ITC and CIC devices, precludes the use of such pickups or receivers with them.

The size of in-the-canal devices, moreover, precludes connection to them by miniature plug and jack connectors and other such conventional coupling systems.

OBJECTS OF THE INVENTION

It is, therefore, the principal object of the present invention to provide an improved hearing instrument which can avoid the aforedescribed drawbacks and enhance the versatility of in-the-canal devices both of the ITC and CIC type.

Another object of the invention is to provide an improved hearing instrument which eliminates some of the drawbacks of in-the-canal devices and enables such devices to be provided with inputs from a variety of sources.

A more general object of this invention is to provide a high versatility hearing system which is of relatively low cost and can make use of existing technology with respect to in-the-canal devices.

SUMMARY OF THE INVENTION

These objects and other which will become apparent hereinafter are attained, in accordance with this invention, in a hearing instrument which comprises:

an in-the-canal hearing device in an ear canal of a user and having an acoustic pick up and means for amplifying a signal from the acoustic pick up and emitting sound waves in the canal;

a behind-the-ear device located behind the ear of the user and provided with a wireless signal pick up element and an amplifier; and coupling means between the behind-the-ear device and the in-the-canal device and including an elongated signal delivery element connected to an output of the amplifier of the behind-the-ear device and running into the canal at least proximal to the in-the-ear device for delivering amplified signals from the behind-the-ear device to the in-the-ear device.

The system of the invention can provide acoustic coupling between the behind-the-ear devices and the in-the-canal device. In that case, the behind-the-ear device has an open-end tube which extends from the behind-the-ear device and particularly the ear hook thereof into the canal close to the microphone or acoustic pick up port of the in-the-canal device. To provide a flat frequency response and improve the response for low frequency, the tube extending from the electroacoustic transducer of the behind-the-ear device is branched and includes a terminated end tube which is tuned to provide a phase cancelling function reducing high frequency resonances by the open end tube.

The behind-the-ear device is preferably a wireless FM receiver with a level typically higher than that of the environmental noise acoustic output (typically 80dBSPL). The transmitting unit to which the receiver responds can be placed near a sound source and delivers a signal free from significant noise so that the overall sound delivery is characterized by a substantial noise reduction by comparison with sound transmitted from the original source through space to the listener. The receiver can alternatively be an IR receiver or inductive pick up.

The advantage of acoustic coupling is that it eliminates any need for hardwire connections. For enhanced signal to noise ratio, the user equipped with an ITC or CIC device need only additionally place the wireless BTE device behind his or her ear and position the open end tube proximal to the microphone port of the in-the-canal device.

In a second embodiment of the invention, a wired connection is provided between the behind-the-ear device and the in-the-ear canal device utilizing the battery compartment of the in-the-canal device. This connection does not require the addition of any space-occupying parts to the CIC or ITC.

In-the-canal devices have battery compartments normally receiving a small disk-shaped battery. Within the compartment, there is a pair of contacts or terminals for connection to the opposite poles of the battery. According to this aspect of the invention, there is provided within the compartment a further terminal which can be connected by a conductor to the output of the amplifier of the behind-the-ear device and which delivers the amplified signal from the latter to the circuitry of the in-the-canal device.

More particularly, the elongated signal delivery element can be a cable which extends from the BTE via the ear hook and has three conductors with a terminus in the form of a dummy battery with terminals connectable to the battery terminal of the compartment and a signal terminal from the signal conductor. One conductor carries ground and the negative from the BTE battery, another conductor carries the signal from the amplifier relative to ground and the third conductor carries the positive voltage from the BTE battery. The third contact in the battery compartment, which connects to the signal conductor, can be tied to a summing circuit of the in-the-canal device for combining the amplified signal from the electroacoustic transducer and amplifier of the BTE with the signal from the microphone of the in-the-canal device.

BRIEF DESCRIPTION OF THE DRAWING

The above and other objects, features, and advantages will become more readily apparent from the following description, reference being made to the accompanying drawing in which.

SPECIFIC DESCRIPTION

Figure 1B:
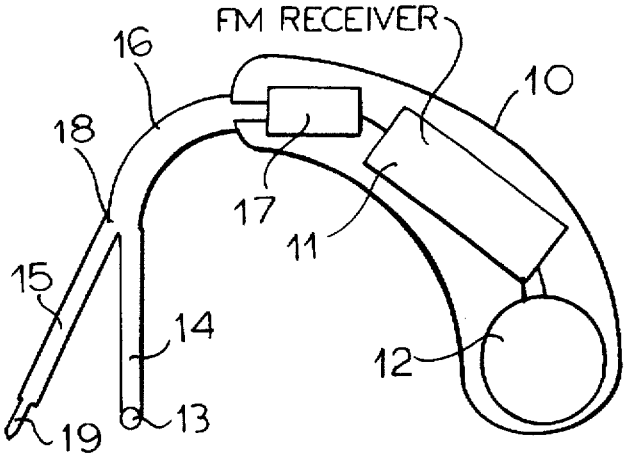
FIG. 1B is a diagram of the essential parts of the device of FIG. 1A.
Figure 1A:
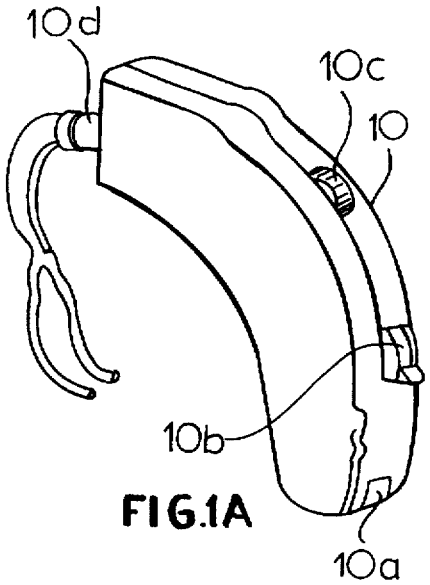
FIG. 1A is a perspective view of a behind-the-ear hearing device for use in the hearing instrument system of the invention, utilizing a split signal delivery tube.
Figure 1D:
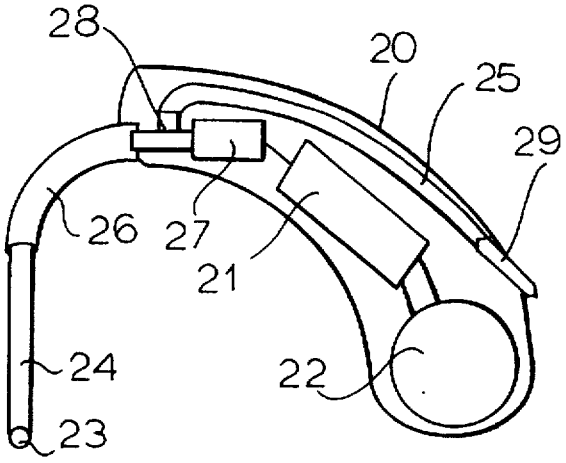
FIG. 1D is a diagram similar to FIG. 1B for the device of FIG. 1C.
Figure 1C:
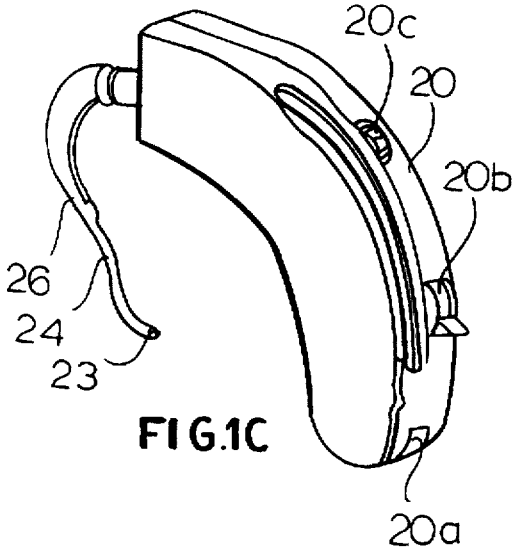
FIG. 1C is a perspective view similar to FIG. 1A of another embodiment.
Figure 1E:
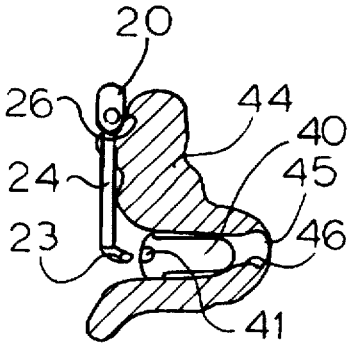
FIG. 1E is a diagram of the relationship between the in-the-canal device and the behind-the-ear device in the first embodiment of the invention.

As can be seen from FIG. 1E, a behind-the-ear hearing devices (FIGS. 1A through 1D and FIG. 3) can be mounted behind the pinna of the ear 44 whose tympanic membrane 45 is seen at the end of the auricular meatus or canal 46. Placed within this canal is an in-the-canal hearing aid 40 which can be of the ITC or CIC type with its microphone hole represented at 41, i.e. at the end turned away from the tympanic membrane 45. The behind-the-ear unit 20 has an ear hook 26 from which a tube 24 runs into the ear canal and extends with a bent end 23 whose port is open toward the microphone 41.

A typical behind-the-ear unit is shown in FIG. 1A to have a housing 10 formed with a battery compartment 10*a*, an on/off switch 10*b* and a volume control 10*c*. Within the housing (FIG. 1B) the battery 12 is visible along with the circuitry 11 which can be an FM receiver and amplifier connected to an electroacoustic output transducer 17 whose acoustic output is applied through the tube 10*d* of the housing to an ear hook 16 which communicates with two tubes 14 and 15 at a Y-shaped junction 18. The tube 14 is equivalent to the tube 24 previously described and terminates in the bent open end 13 which is positioned adjacent the microphone port 41. The other tube 15 is sealed by a resonance adapter 19 which adjusts the resonance of the sealed tube to the length of the open tube 14.

In the embodiment of FIGS. 1C and 1D, the housing 20 of the BTE is again provided with the battery compartment 20*a*, the on/off switch 20*b*, volume control 20*c*, but a T-junction 28 from the electroacoustic transducer 27 branches the output to the closed tube 25 which extends back within the housing or over the housing 20 and terminates in the resonant adapter 29. The open end tube 24 with the port 23 extends from the ear hook 26 and the other side of the T-shaped adapter 28. The sealed tube or terminated-end tube 25 provides the phase cancelling function described to reduce the high frequency resonance caused by the open end tube. The circuitry is represented at 21 in FIG. 1D.

Figure 3:
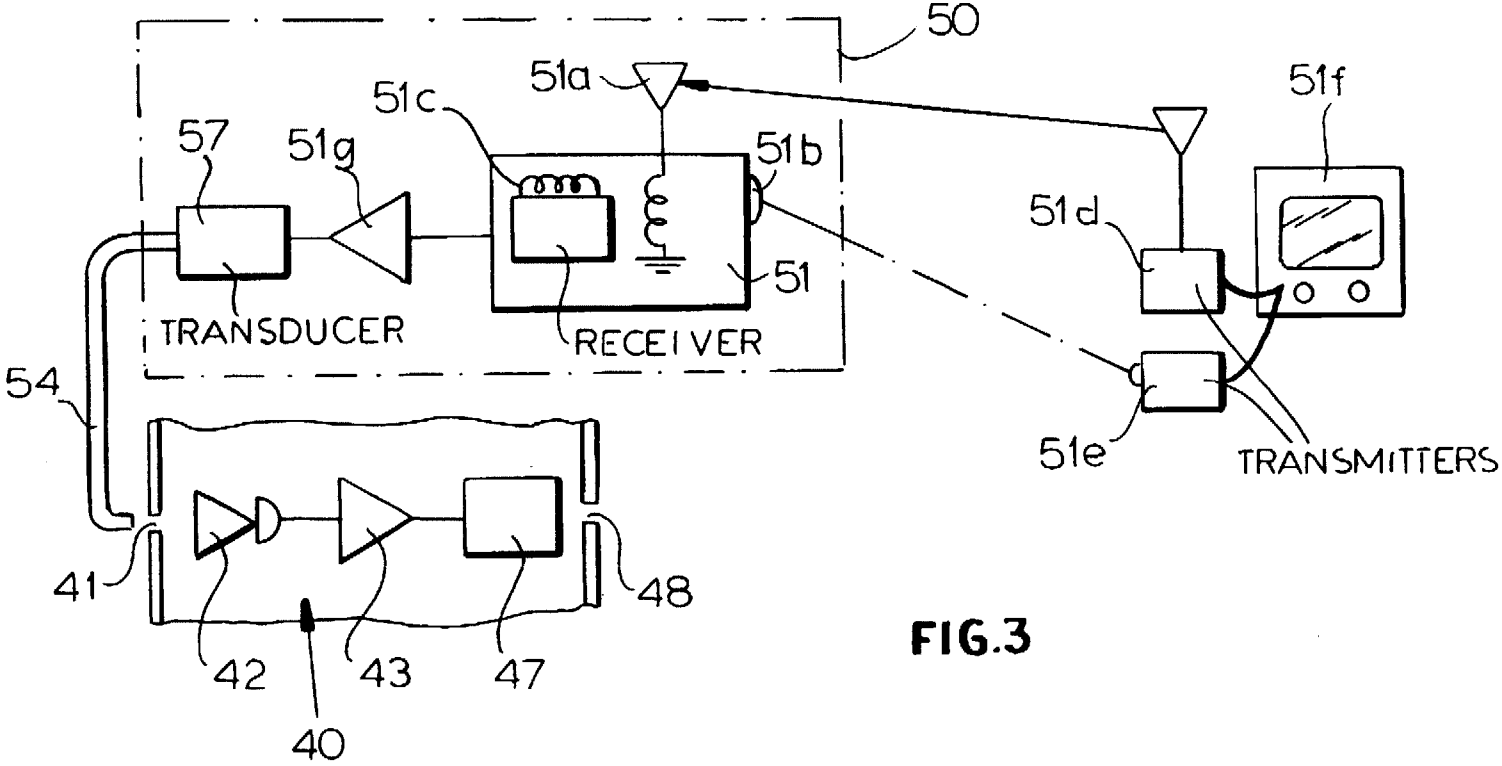
FIG. 3 is a circuit diagram illustrating the principles of the first embodiment.

As can be seen from FIG. 3, the behind-the-ear unit 50 has a receiver 51 which may be the FM transmitter previously described with an antenna 51*a* or some other receiver obtaining input from, say, an infrared pick up 51*b* or an inductive pick up or coil 51*c*, the latter being sensitive to a telephone receiver ear piece placed in the vicinity of the BTE.

A relatively clean signal, i.e. one substantially free from noise, can be transmitted to the receiver 51 from a FM transmitter 51*d* or an infrared transmitter 51*e* placed in the region of the sound source shown here diagrammatically to be a television set 51*f*. The infrared or FM (wireless) transmission to the receiver 51 is picked up and amplified at 51*g* before being fed to the electroacoustic transducer 57.

The open output tube 54 of the behind-the-ear unit 50 is juxtaposed with the microphone port 41 of the in-the-canal unit 40 which can have a microphone 42 working into the amplifier 43 whose output is applied to the electroacoustical transducer 47. An output port 48 serves to transmit the sound signal to the tympanic membrane closely juxtaposed with the in-the-canal hearing device. With this system, without any modification whatever to the ITC and CIC at 40, a clean signal delivered to the behind-the-ear unit can be fed to the in-the-canal unit.

Figure 2B:
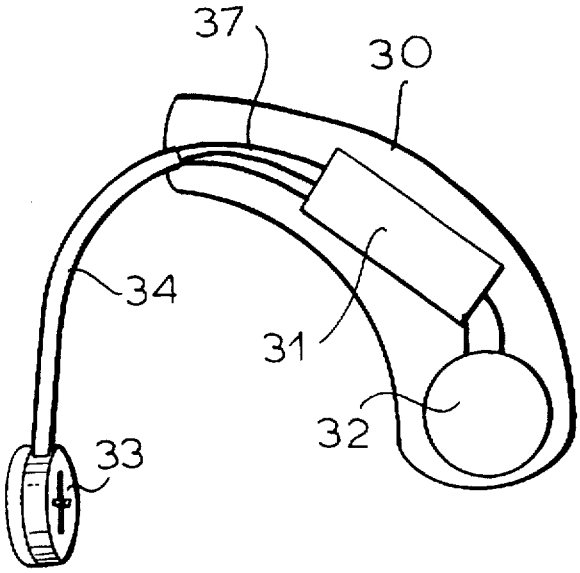
FIG. 2B is a diagram showing the essential parts of the unit of FIG. 2A.
Figure 2A:
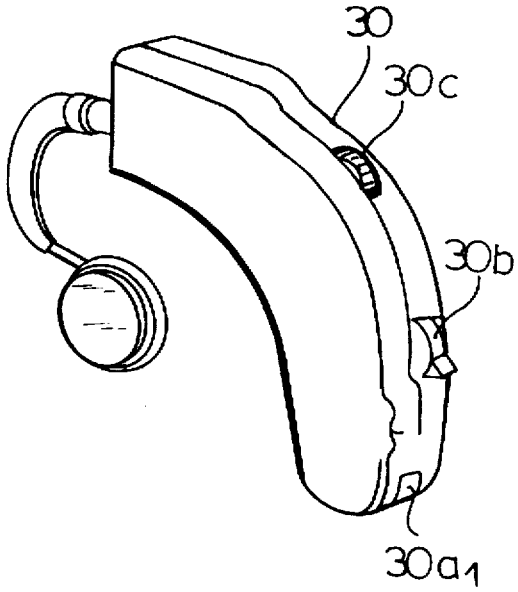
FIG. 2A is a perspective view similar to FIG. 1A of a behind-the-ear unit for use in the second embodiment of the invention.
Figure 2C:
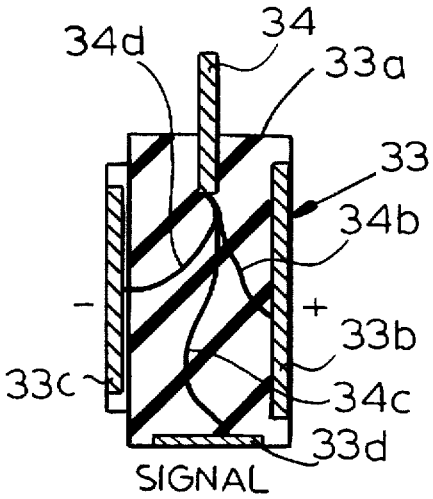
FIG. 2C is a diagram showing the dummy battery terminating the signal delivery element in this second embodiment.
Figure 2D:
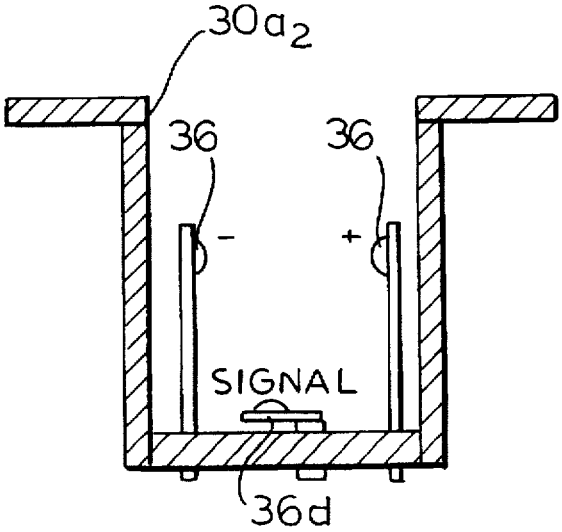
FIG. 2D is a cross sectional view through the battery compartment of the in-the-canal unit showing the terminals cooperating with the terminals of the dummy battery.

A similar principle applies for the second embodiment shown in FIGS. 2A through 2D and FIG. 4. In FIG. 2A, there is shown a behind-the-ear unit 30 with a battery compartment 30*a*, an on/off switch 30*b* and a volume control 30*c*. Here, however, instead of a tube, the receiver 31 (FIG. 2B) feeds three conductors 37 forming part of a miniature cable 34 terminating in a dummy battery. The latter can comprise an insulating body 33*a* having conductive plates 33*b*, 33*c* and 33*d* to which respective leads 34*b*, 34*c* and 34*d* of the cable 34 are connected. The plates 33*b* and 33*c* are the equivalent of the positive battery terminal and the negative battery terminal and ground from the battery 32 of the behind-the-ear unit while the terminal 33*d* is connected to the signal line 33*c* of the cable. The dummy battery of FIG. 2C is inserted into the battery compartment $30a_2$ of the in-the-ear canal unit 65. Within this battery compartment, terminals 36*b* and 36*c* are provided which normally engage the positive and negative battery terminals and, in the embodiment described, engage the plates 33*b* and 33*c*. A further terminal 36*d* is connected to the signal terminal 33*d* of the dummy battery 33.

Figure 4:
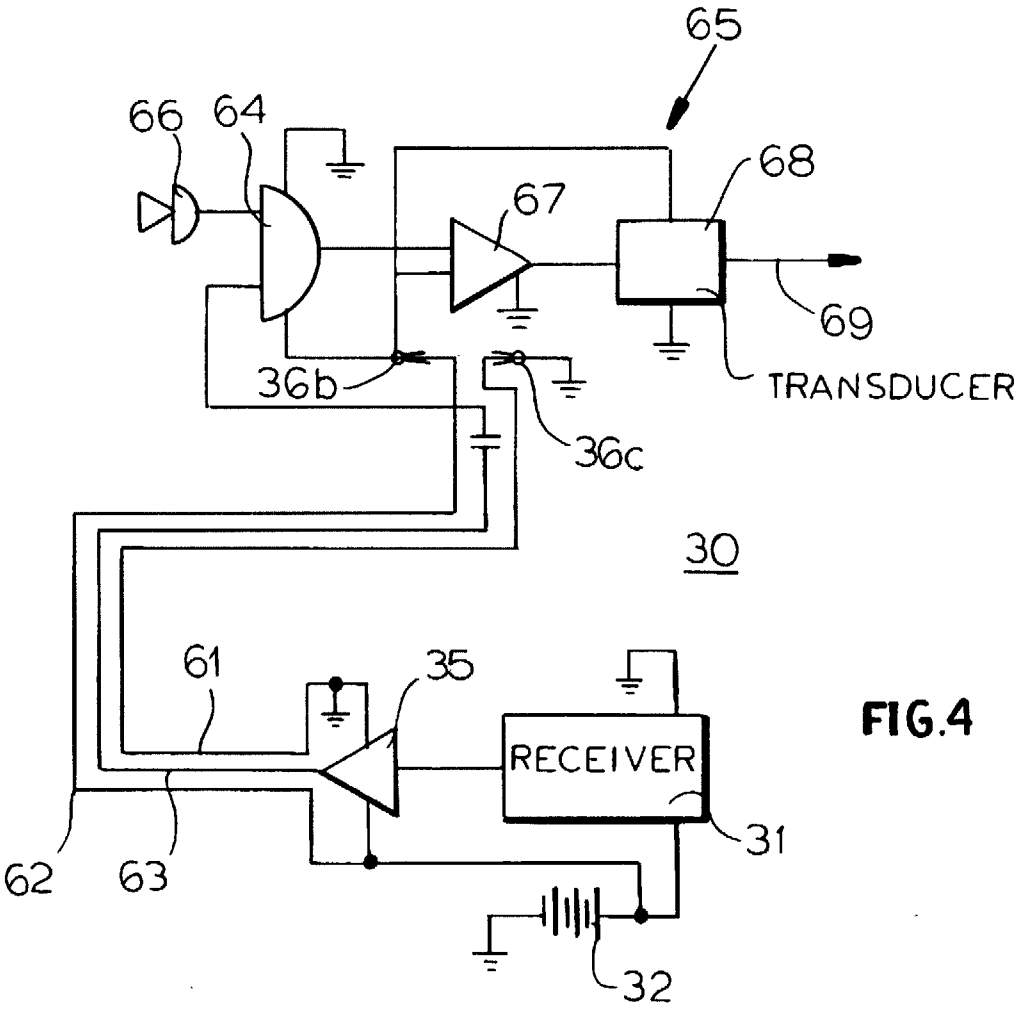
FIG. 4 is a circuit diagram illustrating the principles of the second embodiment.

From FIG. 4 it can be seen that conductors 61 and 62 can be connected respectively to ground and to the positive terminal of the battery 32 of the behind-the-ear unit 30 whose receiver 31 is likewise energized by this battery and is connected to ground. The output of the receiver 31 is applied through an amplifier 35 to the conductors 63. The conductors 61 and 62 terminate in the leads 34*d* and 34*b* previously described while the conductor 63 terminates in the lead 34*c*.

When the connection is made to the in-the-canal unit, therefore, the amplifier signal from line 63 can be applied to a summing circuit 64 of the in-the-canal unit 65, another input to the summing circuit deriving from the microphone 66 of the in-the-canal unit.

The output from the summing circuit is applied to amplifier 67 which, in turn, feeds the electroacoustical transducer 68 to output an acoustic signal 69 to the tympanic membrane as has been described. Within the in-the-canal unit 65, line 61 is connected at 36*c* to ground while line 62 is connected at 36*b* to the positive terminal of the battery compartment of the in-the-canal unit.

The device of FIGS. 2A through 2D and FIG. 4 thus provides a direct connection between the BTE unit and the in-the-canal unit without requiring any special plug and jack configurations to be added to the in the canal unit.

What is claimed is:

1. A hearing instrument comprises:

an in-the-canal hearing device in an ear canal of a user and having an acoustic pick up and means for amplifying a signal from said acoustic pick up and emitting sound waves in said canal;

an electromagnetic-wave wireless behind-the-ear device located behind the ear of the user and provided with a signal pick up element, an amplifier and an electroacoustic transducer; and coupling means between the behind-said-ear device and the in-the-canal device and including an elongated signal delivery element having an open end tube, said open end tube connected to an output of the electroacoustic transducer of the behind-the-ear device and running into the canal at least proximal to the in-the-ear device for delivering amplified signals from the behind-the-ear device to said in-the-ear device.

2. The hearing instrument defined in claim 1 wherein the signal pick up element is a frequency modulation receiver.

3. The hearing instrument defined in claim 1 wherein the signal pick up element is an infrared receiver.

4. The hearing instrument defined in claim 1 wherein the signal pick up element is an inductive signal pick up element.

5. A hearing instrument comprises:

an in-the-canal hearing device in an ear canal of a user and having an acoustic pick up and means for amplifying a signal from said acoustic pick up and emitting sound waves in said canal;

a wireless behind-the-ear device located behind the ear of the user and provided with a signal pick up element and, an amplifier; and coupling means between the behind-said-ear device and the in-said-canal device and including an elongated signal delivery element connected to an output of the amplifier of the behind-the-ear device and running into the canal at least proximal to the in-the-ear device for delivering amplified signals from the behind-the-ear device to said in-the-ear device, the elongated signal delivery element being an open-end air tube having an end positioned close to the microphone of the in-the-canal devices, the behind-the-ear device having an electrical-acoustic transducer connected to the amplifier and generating acoustic signals in the tube.

6. The hearing instrument defined in claim 5 wherein the open-end tube is connected to a further tubing having a closed end.

7. The hearing instrument defined in claim 6 wherein a pair of tubes extend from the transducer, one of the tubes having an open end close to the microphone of the in-the-canal device and the other of the tubes having a closed end.

8. The hearing instrument defined in claim 5 wherein the signal pick up element is a frequency modulation receiver.

9. The hearing instrument defined in claim 5 wherein the signal pick up element is an infrared receiver.

10. The hearing instrument defined in claim 5 wherein the signal pick up element is an inductive signal pickup element.

11. A hearing instrument comprises:

an in-the-canal hearing device in an ear canal of a user and having an acoustic pick up and means for amplifying a signal from said acoustic pick up and emitting sound waves in said canal;

a wireless behind-the-ear device located behind the ear of the user and provided with a signal Pick up element and, an amplifier; and coupling means between the behind-said-ear device and the in-said-canal device and including an elongated signal delivery element connected to an output of the amplifier of the behind-the-ear device and running into the canal at least proximal to the in-the-ear device for delivering amplified signals from the behind-the-ear device to said in-the-ear device, the elongated signal delivery element comprising a multiconductor cable having a terminus fitted to a battery compartment of the in-the-canal device, the cable including conductors connected to battery terminals of the in-the-canal device and a signal conductor connecting the amplifier of the behind-the-ear device with circuitry of the in-the-canal-device.

12. The hearing instrument defined in claim 11 wherein the circuitry includes a summing circuit combining signals from the microphone of the in-the-canal device with signals from the amplifier of the behind-the-ear device.

13. The hearing instrument defined in claim 11 wherein the signal pick up element is a frequency modulation receiver.

14. The hearing instrument defined in claim 11 wherein the signal pick up element is an infrared receiver.

15. The hearing instrument defined in claim 11 wherein the signal pick up element is an inductive signal pick up element.

* * * * *